US008795587B2

(12) United States Patent
Nazarbaev et al.

(10) Patent No.: US 8,795,587 B2
(45) Date of Patent: Aug. 5, 2014

(54) 'KAZAKHSTANSKIY' ALLOY FOR STEEL DEOXIDATION AND ALLOYING

(75) Inventors: Nursultan Abishevich Nazarbaev, Astana (KZ); Vladimir Sergeevich Shkolnik, Astana (KZ); Abdurassul Aldashevich Zharmenov, Kazakhfilm (KZ); Manat Zhaksybergenovich Tolymbekov, Karaganda (KZ); Sailaubay Omarovich Baisanov, Karaganda (KZ)

(73) Assignee: RSE the National Center on Complex Processing of Mineral Raw Material of the Republic Kazakhstan, Almaty (KZ)

( * ) Notice: Subject to any disclaimer, the term of this patent is extended or adjusted under 35 U.S.C. 154(b) by 162 days.

(21) Appl. No.: 12/937,910

(22) PCT Filed: Sep. 18, 2008

(86) PCT No.: PCT/KZ2008/000004

§ 371 (c)(1),
(2), (4) Date: Oct. 14, 2010

(87) PCT Pub. No.: WO2009/131428

PCT Pub. Date: Oct. 29, 2009

(65) Prior Publication Data

US 2011/0044845 A1 Feb. 24, 2011

(30) Foreign Application Priority Data

Apr. 22, 2008 (KZ) ..... 2008/0409

(51) Int. Cl.
*C22C 35/00* (2006.01)

(52) U.S. Cl.
CPC ..... *C22C 35/00* (2013.01)
USPC ..... 420/578; 420/580

(58) Field of Classification Search
CPC ..... C22C 35/00; C22C 30/00
USPC ..... 420/578, 580
See application file for complete search history.

(56) References Cited

U.S. PATENT DOCUMENTS

| | | | | |
|---|---|---|---|---|
| 3,131,058 | A * | 4/1964 | Ototani | 420/85 |
| 3,275,433 | A * | 9/1966 | Hilty et al. | 420/578 |
| 3,383,202 | A * | 5/1968 | Lynch | 420/581 |

FOREIGN PATENT DOCUMENTS

| | | | |
|---|---|---|---|
| EP | 0 268 679 | A1 | 6/1988 |
| RS | 990853 | A | 1/1983 |
| RU | 406939 | A | 4/1974 |
| RU | 998560 | A | 2/1983 |
| RU | 2200767 | C2 | 3/2003 |

* cited by examiner

*Primary Examiner* — Jie Yang
(74) *Attorney, Agent, or Firm* — Birch, Stewart, Kolasch & Birch, LLP

(57) ABSTRACT

Ferrous metallurgy for producing an alloy for reducing, doping and modifying steel is disclosed. The quality of the steel treated with the inventive alloy is improved owing to the deep reduction and modification of non-metallic impurities and the simultaneous microalloying of steel with barium, titanium and vanadium. Barium, titanium and vanadium are added into the inventive alloy, which contains aluminum, silicon, calcium, carbon and iron, with the following component ratio, in mass %: 45.0-63.0 silicon, 10.0-25.0 aluminum, 1.0-10.0 calcium, 1.0-10.0 barium, 0.3-5.0 vanadium, 1.0-10.0 titanium, 0.1-1.0 carbon, the rest being iron.

2 Claims, No Drawings

'KAZAKHSTANSKIY' ALLOY FOR STEEL DEOXIDATION AND ALLOYING

Technical result that is being achieved is quality improvement of treated steel through the alloy being claimed due to deep deoxidization and modification of nonmetallics and simultaneous microalloying of steel by barium, titanium and vanadium.

According to the invention, barium, vanadium and titanium are added to the alloy that contains aluminum, silicon, calcium, carbon and iron, with the following correlation of components, mass. %:

| | |
|---|---|
| Silicium | 45.0-63.0 |
| Aluminum | 10.0-25.0 |
| Calcium | 1.0-10.0 |
| Barium | 1.0-10.0 |
| Vanadium | 0.3-5.0 |
| Titanium | 1.0-10.0 |
| Carbon | 0.1-1.0 |
| Iron | balance. |

The innovation falls under the area of ferrous metallurgy, particularly, under processes of creating alloy for deoxidization, alloying and inoculation of steel.

There is an alloy that is known for deoxidization and alloying of steel (A.c. 990853, USSR, class C22C 35/00. published 1983. #3); makeup, mass %: 30.0-49.0 silicon; 6.0-20.0 calcium; 4.0-20.0 vanadium; 1.0-10.0 manganese; 1.5-4.0 titanium; 1.5-5.0 magnesium; 0.3-0.8 aluminum; 0.5-1.5 phosphorus; balance is iron.

Disadvantage of this alloy is the presence of phosphorus which negatively effects quality of steel, particularly this can result in cold brittleness. Lower content of silicon and aluminum in the alloy does not ensure sufficient deoxidization of steel. For a greater recovery of alloying elements of this alloy it is necessary to deoxidize steel with aluminum first. Otherwise increased consumption of alloy will be required.

The closest in makeup to the claimed alloy is alloy for steel deoxidization and alloying (patent of RK #3231, cl. C22C 35/00, published on 15.03.96, report #1) which contains the following components, mas. %: 15.0-30.0 aluminum; 45.0-55.0 silicon; 1.0-3.0 calcium; 0.1-0.3 magnesium; 0.1-0.8 carbon; balance is iron. The alloy is made by coke reduction of coal ashes. Technical and chemical compositions of charging materials are presented in Chart 1.

CHART 1

Technical makeup and chemical compositions of coal ash and coke

| | | | | | Chemical Makeup, % | | | | | | |
|---|---|---|---|---|---|---|---|---|---|---|---|
| Material | C10, % | Ac, % | Wc, % | Vc, % | SiO2 | Fe2O3 | Al2O8 | CaO | MgO | SO3 | TiO2 |
| Coal ash | 13.02 | 82.5 | 1.2 | 4.48 | 58.6 | 10.2 | 22.0 | 2.25 | 1.5 | 0.2 | 0.99 |
| Coke | 62.0 | 31.0 | 0.41 | 7.0 | 60.02 | 8.0 | 22.7 | 2.6 | 1.65 | 1.7 | 1.0 |

Disadvantage of this alloying (of the prototype) process is that qualitative characteristics of steel treated with this type of alloy are not high enough as this makeup of alloy does not deoxidizes steel sufficiently and as a result the steel made has low characteristics. Increase of the amount of oxygen in steel treated with the known alloy (the prototype) that amounts to 0.0036% facilitates increase of residual amounts of oxide inclusions (up to 0.097% in steel. This is a result of a lower content of calcium which is a modifying element, which does not allow to remove nonmetallics more fully and reduce their amount lower than 0.0082%. Moreover, use of coke and coal ashes in the make up of charging mixture negatively effects the melting process in a form of increased agglomerating of charging materials on the surface of electric furnace top and leads to trouble in process fume extraction. Fusible ash begins to flash off intensively and results in premature slag-making; poor gas permeability and ejection of main elements into gaseous phase through high-temperature gas runouts. Power consumption rate in alloy-making is 11.0-11.6 mW-hour/t. meanwhile calcium content does not exceed 3.9%.

The aggregate of the above-mentioned disadvantages facilitates decrease of qualitative characteristics of steel being melted, particularly, impact hardness (−40° C.) does not exceed 0.88 mJ/m$^2$.

The accomplished technical result is improvement in quality of steel treated with claimed alloy due to deep deoxidization and inoculation of nonmetallic inclusions and simultaneous microalloying of steel with barium, titanium and vanadium.

The essence of the invention being offered is as follows:

The alloy for deoxidization, alloying and inoculation of steel that contains aluminum, silicon, calcium, carbon and iron, additionally contains barium, vanadium and titanium in the following correlation, in mas. %:

| | |
|---|---|
| Silicium | 45.0-63.0 |
| Aluminum | 10.0-25.0 |
| Calcium | 1.0-10.0 |
| Barium | 1.0-10.0 |
| Vanadium | 0.3-5.0 |
| Titanium | 1.0-10.0 |
| Carbon | 0.1-1.0 |
| Iron | balance. |

The content of deoxidizing elements in the makeup of alloy within specified limits allows to lower the amount of oxygen in steel volume 1.4-1.8-fold in comparison to the known alloy (the prototype). That allowed to raise beneficial use of vanadium up to 90%. Recovery of manganese from silicomanganese into steel was raised by 9-12% reaching 98.8% due to a deep deoxidization and oxygen shielding by active calcium, barium, aluminum and silicon. Barium and calcium within the specified limits, besides deoxidization, also play a role of active desulphurizers; dephosphorizing agents and conditioning agents for nonmetallic inclusions (NI), increasing their smelting capacity due to complexity, significantly reduce total amount of NI in steel. In the presence of calcium, barium and titanium residual sulfur and oxide is inoculated into fine oxysulfides and complex oxides with equal distribution in scope of steel without development of stringers and of their pileups. Amount of residual oxide nonmetallic inclusions reduced by 1.16-1.35 times than in steel treatment with alloy (the prototype).

Microalloying with vanadium and titanium in contrast to the use of the known alloy (the prototype) significantly improves mechanical properties of treated steel. Thus, impact hardness at (−40° C.) has reached the values of 0.92-0.94 $mJ/m^2$.

Proposed alloy increases transfer of manganese into steel during its treatment both with manganese-containing concentrates in direct alloying, and from ferroalloys. Manganese extraction was raised by 0.3-0.5%; amount of oxide inclusions reduced by 20%; impact hardness became 0.04-0.06 $mJ/m^2$ higher than when using the known alloy (the prototype). The alloy is made of high-ash coal-mining coal wastes with addition of low-intensify splint coal; lime; barium ore; vanadium-containing quartzite and ilmenite concentrate. Use of coke is eliminated. Specific power consumption is 10.0-10.9 mW/h. In the process of alloy melting, as opposed to the known alloy (the prototype) a high-ash carbonaceous rock and splint coal are used. Carbonaceous rock contains 50-65% ashes, in which the amount of silicon oxide and aluminum oxide is not less than 90%, contains sufficient amounts of natural carbon for reducing processes, which is technological and economically feasible. Splint coal additives that have the properties of charge debonder, improve gas permeability of upper layers of the shaft top and extraction of process gas. Power consumption in alloying of the claimed alloy is 8.7% lower compared to the prototype.

EXAMPLE

Makeup of the alloy being charged was melted in an ore-smelting furnace with transformer power 0.2 MBA. Chemical and technical compositions of used charging materials are represented in Charts 2 and 3.

CHART 2

Technical analysis of carbonaceous rock and coal

| | Content, % | | | | |
|---|---|---|---|---|---|
| Material | Ac | Vc | W | C12 | S |
| Carbonaceous rock | 57.6-59.8 | 16.0 | 4.0 | 20.0-22.4 | 0.05 |
| Coal | 4.0 | 40.1 | 10.7 | 55.9 | 0.36 |

CHART 3

Chemical analysis of charging material

| | Content, % | | | | | | | | | |
|---|---|---|---|---|---|---|---|---|---|---|
| Material | SiO2 | Al2O3 | Fe2O3 | CaO | MgO | TiO2 | BaO | V | S | P |
| Carbonaceous rock | 57.6 | 34.2 | 5.72 | 0.7 | 0.4 | 1.2 | — | — | 0.05 | 0.015 |
| Coal | 53.5 | 27.1 | 8.35 | 6.19 | 3.89 | — | — | — | — | 0.012 |
| Vanadium-containing quartzite | 94.3 | 1.1 | 1.2 | 0.4 | 0.3 | — | — | 0.8 | — | 0.15 |
| Barium ore | 35.7 | 1.0 | 1.0 | 2.0 | — | — | 44.0 | | 8.57 | 0.02 |
| Ilmenite concentrate | 7.4 | 3.4 | 16.8 | 2.2 | 1.7 | 59.7 | — | 3.0 | 0.01 | 0.015 |
| Lime | 0.2 | 0.3 | 1.5 | 92.0 | 5.95 | — | — | — | 0.02 | 0.03 |

As a result of test procedures it was established that the least specific power consumption; stable furnace operation and better gas permeability of furnace mouth comply with melting of the offered alloy composition. That excludes carbide forming and improves technological properties of furnace mouth and as a result—its operation.

Evaluation of deoxidizing and alloying capacity of the claimed and of the known (prototype) alloys was performed in the open coreless induction furnace IST-0.1 (capacity 100 kg) in melting of low-alloyed steel grades (17GS, 15GUT). Scrap metal with 0.03-0.05% of carbon and up to 0.05% of manganese was used as a metal charge.

After obtaining metallic melt and bringing it up to the temperature up to 1630-1650° C. the metal was poured into a ladle. Deoxidization with the claimed alloy and alloy (the prototype) was performed in a ladle together with silicomanganese SMn 17 based on obtaining up to 1.4% of manganese in steel. Manganese extraction rate into alloy was determined by chemical composition of metal samples. Metal was ladled into ingots that later were rolled into 10-12 mm sheets. Results of deoxidization and alloying are shown in Chart 4.

The claimed alloy was used in steel treatment in experimental production when steel was treated with alloys #5-9 (Chart 4). In these productions the maximal recovery of manganese from silicomanganese into steel was 96.0-98.9% which is 9-12% higher than in using prototype alloy. Increase of manganese extraction can be explained by fuller steel deoxidization due to high content of silicon and aluminum and presence of calcium, barium and titanium in the claimed alloy. Oxygen content in experimental steel treated with alloys #5-9 was reduced by 1.4-1.8 times to the values of 0.002-0.0026%, than in steel treated with prototype alloy—0.003-0.0036% correspondingly.

In order to evaluate qualities and mechanical properties of obtained metal amount of nonmetallic inclusions was determined according to GOST 1778-70. During deoxidization with the claimed alloy nonmetallic inclusions were smaller and of globular form, with no alumina stringers or accumulations of oxides, unlike in using the alloy (the prototype).

This is provided because of calcium and barium in the content of the alloy, which, apart from desulphurizing and dephosphorizing capacity also display inoculating properties that are analogical to capillary active substances, which is evident from oxides coagulation into easily fusible complexes that are easy to remove from steel volume. Content of residual oxide NI was reduced to 0.007-0.0075% compared to deoxidization with the known alloy (the prototype), which amounted to 0.0084-0.0097%. Microalloying with vanadium and titanium in the claimed alloy have allowed to increase the impact hardness, moldability and hardness of experimental steel. The impact hardness at (−40° C.) increased to 0.92-0.94 mJ/m$^2$ versus 0.82-0.88 mJ/m$^2$; flow limit (σт)—490-510 mPa; percentage extension (σ5)—35-37%; ultimate resistance (σB)—610-629 mPa. Obtained correlation of components in the claimed alloy complies with the optimal and allows to use it for deoxidization and alloying of semikilled and low-alloy grades of steel, ensuring even formation of easily fusible complex NI that are easily removed from steel volume, and transforming residual NI into finely dispersed and of optimal globular shape.

At the same time exceeding the acceptable limits of concentration of these elements is unreasonable as it increases specific power consumption in the process of obtaining the alloy being claimed and positive properties that result from its application are not very different from declared limits in their makeup.

Thus, compared to prototype, due to additional content of barium, vanadium and titanium in the alloy, the invention that is being offered allows to:

perform deeper steel deoxidization;

significantly reduce the content of nonmetallic inclusions;

inoculate residual nonmetallic inclusions into favorable complexes equally distributed in steel volume;

increase the rate of manganese extraction into steel;

increase impact hardness of steel;

moreover, economical feasibility of alloying, is in the use of inexpensive high-ash carbonaceous rocks, excluding the use of expensive coke.

Results of experimental productions of 17GS and 15GUT grades steel had shown high effectiveness of the claimed alloy.

CHART 4

Technical and Economic Indicators of Steel-Making, Deoxidization and Alloying Process

| # of | Alloy-making | | | | | | | | | Steel Treatment | | | | |
|---|---|---|---|---|---|---|---|---|---|---|---|---|---|---|
| | Constitution of alloy, % | | | | | | | | Specific power consumption, | Content in steel, % | | Mn Extraction | Amount of | Impact hardness, AH (−40o), |
| Melting | Si | Al | Ca | Ba | V | Ti | C | Fe | mW/hour | Mn | O | rate, % | Oxides, % | mJ/m2 |
| On Prototype | | | | | | | | | | | | | | |
| 1 | 45 | 15 | 1.0 | — | — | — | 0.10 | 38.8 | 11.0 | 1.12 | 0.0036 | 95.7 | 0.0097 | 0.82 |
| 2 | 55 | 30 | 3.0 | — | — | — | 0.8 | 10.9 | 11.6 | 1.11 | 0.003 | 98.3 | 0.0084 | 0.88 |
| On Claimed alloy | | | | | | | | | | | | | | |
| 3 | 43.5 | 26.2 | 0.5 | 0.2 | 0.2 | 11.0 | 1.35 | Balance | 12.2 | 0.09 | 0.0045 | 88.5 | 0.0098 | 0.84 |
| 4 | 42.1 | 6.5 | 11.0 | 11.2 | 5.4 | 2.1 | 1.2 | Balance | 12.8 | 0.78 | 0.0039 | 94.0 | 0.0095 | 0.85 |
| 5 | 52.5 | 17.1 | 1.7 | 4.3 | 2.6 | 7.4 | 0.15 | Balance | 10.2 | 1.31 | 0.0024 | 98.5 | 0.0072 | 0.93 |
| 6 | 55.0 | 16.2 | 10.0 | 1.0 | 4.7 | 2.2 | 0.11 | Balance | 10.4 | 1.29 | 0.0022 | 98.7 | 0.0070 | 0.94 |
| 7 | 63.0 | 10.0 | 1.0 | 2.55 | 5.0 | 10.0 | 0.1 | Balance | 10.1 | 1.30 | 0.0023 | 98.8 | 0.0072 | 0.92 |
| 8 | 50.0 | 22.0 | 3.0 | 10.0 | 0.3 | 2.3 | 0.31 | Balance | 10.0 | 1.35 | 0.0020 | 98.6 | 0.0072 | 0.94 |
| 9 | 45.0 | 25.0 | 5.4 | 4.3 | 4.4 | 1.0 | 1.0 | Balance | 10.9 | 1.38 | 0.0026 | 98.5 | 0.0075 | 0.94 |
| 10 | 64.1 | 6.7 | 0.7 | 0.32 | 0.27 | 4.37 | 0.07 | Balance | 12.4 | 0.75 | 0.0037 | 85.0 | 0.0091 | 0.69 |
| 11 | 66.2 | 9.2 | 0.1 | 1.5 | 0.25 | 0.16 | 0.08 | Balance | 13.0 | 0.72 | 0.0058 | 82.4 | 0.0098 | 0.86 |

Accepted limits of components ratio in the alloy are rational. Particularly, decrease in concentration of calcium, barium, vanadium and titanium lower than established limit in the alloy does not ensure the desired effect of deoxidization; alloying and inoculation of residual NI in steel treatment. Thus, steel treatment with alloy obtained in melting #3 with low content of silicon, calcium and barium, in spite of high content of aluminum and titanium does not deoxidize steel sufficiently; contains high amount of alumina and oxide NI stringers, and mechanical properties are at the level of steel treated with alloy (prototype).

The invention claimed is:

1. An alloy for steel deoxidization and alloying, comprising: 10.0-25.0 mass % aluminum, 45.0-63.0 mass % silicon, 1.0-5.4 mass % calcium, 0.1-1.0 mass % carbon, 1.0-10.0 mass % barium, 2.6-5.0 mass % vanadium, and 1.0-10.0 mass % titanium with the balance being iron;

Wherein a content of residual oxide nonmetallic inclusions (NI) in the alloy is 0.007-0.0075 mass %.

2. The alloy according to claim 1, wherein the content of aluminum is 16.2-25.0 mass %.

* * * * *